United States Patent [19]

Dismukes

[11] 4,114,689

[45] Sep. 19, 1978

[54] RECOVERY OF PETROLEUM

[76] Inventor: Newton Bradford Dismukes, 2952 Buttonwood Dr., Carrollton, Tex. 75006

[21] Appl. No.: 800,218

[22] Filed: May 25, 1977

[51] Int. Cl.[2] ..... E21B 43/00; E21B 43/01

[52] U.S. Cl. ..... 166/249; 166/50; 166/52; 166/314; 166/362

[58] Field of Search ..... 166/314, 247, 299, 63, 166/249, 50, 52, 51, 362; 175/67, 64, 213, 422; 299/17, 7, 8; 208/11 R

[56] References Cited

U.S. PATENT DOCUMENTS

| | | | |
|---|---|---|---|
| 2,182,545 | 12/1939 | Pace | 166/314 X |
| 2,700,422 | 1/1955 | Bodine, Jr. | 166/249 |
| 3,057,404 | 10/1962 | Bergstrom | 166/314 X |
| 3,066,733 | 12/1962 | Brandon | 166/299 |
| 3,211,221 | 10/1965 | Huitt | 166/308 X |
| 3,338,306 | 8/1967 | Cook | 166/50 X |
| 3,472,553 | 10/1969 | Miller | 175/64 X |
| 3,628,607 | 12/1971 | Dietz | 166/314 |
| 3,797,590 | 3/1974 | Archibald et al. | 175/67 X |

*Primary Examiner*—Stephen J. Novosad

[57] ABSTRACT

Compaction of friable or unconsolidated strata containing petroleum substance is obtained by increasing the mass of material above the reservoir, vibrating various earth strata and alternately raising and lowering the fluid pressure in the reservoir to yield a maximum reduction in porosity of the reservoir matrix material and thus to expel petroleum substance therefrom. Enlargement of well bore and extension thereof as by drilling lateral wells are contemplated as is the production of solid reservoir material and recovery of other solids which may be compacted by the above steps and be slurrified and caused to flow to a well bore.

30 Claims, 10 Drawing Figures

RECOVERY OF PETROLEUM

BACKGROUND OF INVENTION

Forces which act to produce petroleum hydrocarbons from underground accumulations in earth strata include expansion of the hydrocarbon fluids, influx of extraneous fluids such as water or gas, gravity drainage and naturally occurring compaction and consequent porosity reduction of the reservoir rock material. The present invention relates to recovery of petroleum substances by increasing compactive forces through an increase in the effective overburden pressure on the underground accumulation.

Petroleum hydrocarbons are contained within the pores of reservoir rock material, usually under an initial pressure which is related to the subsurface depth of the accumulation. Petroleum containing earth strata most commonly are limestones or sands. Many of the sand materials are friable loose or unconsolidated. These latter, having a granular nature, support the overburden by point contact between the grains. Also, the pressure of the fluids contained in the pores of the sand furnishes additional support for the overlying strata. When this pressure is decreased by production of petroleum substance through wells the point contacts of the grains have to increasingly sustain the weight of the overburden. When the contact pressure between the grains becomes sufficiently intense grain surface at these contacts may give way or fail thus compacting the earth strata and decreasing the porosity thereof. In other words, a part of the overburden weight is transmitted to the fluid to cause an increase in fluid pressure which in turn causes flow toward lower pressure, usually a well bore.

Compaction and porosity decrease may account for a substantial portion of the oil produced. It has been reported (Transactions of the Society of Petroleum Engineers of AIME, volume 261 (1976), page 1113) that almost half of the petroleum recovered from a major oilfield in Venezuela has resulted from compaction. Another result of compaction frequently is an increase in the amount of solid material produced with the petroleum substance.

When earth strata solid material associated with an accumulation of petroleum substance is produced with that petroleum substance it is obvious that the recovery has been 100 percent complete from that particular rock material. However, to the best of my knowledge and belief this fact has not been taken advantage of heretofore in the production of petroleum through wells, as contrasted with mining. On the contrary, strenuous efforts have been expended to prevent production of earth solids including sand control by screens, by consolidation and by gravel packing. The intentional production of such earth solid materials is contemplated herein.

Several factors affect the compaction-subsidence phenomenon. Surface subsidence is greatest where large areas of thick and relatively shallow sand reservoirs are pressure depleted by fluid production and where substantial quantity of solids is produced with the fluids. Because compaction is caused by the weight or mass of material overlying the petroleum being depleted an increase in that mass will cause additional compaction. Seismic waves or vibrations have the effect of increasing overburden mass because they destroy natural bridging of the particles of earth strata above the accumulation and more of the mass is transmitted directly downward. In other words, vibrations hasten the onset and amount of compaction and incidentally increase surface subsidence. Man made vibrations are contemplated herein as an integral part of the present invention.

Petroleum substances usually are recovered from undergound accumulations through wells drilled more or less vertically from the surface of the earth. Horizontal wells such as those disclosed by various patents including those issued to Leo Hanney, notably U.S. Pat. Nos. 1,634,235 and 2,280,851 may conduct fluids to vertical wells to be lifted to the surface. Both vertical and horizontal wells are employed in the present invention.

Mechanical enlargement of a well bore to extract bitumens, tars or other petroleum substances is disclosed in U.S. Pat. No. 3,472,553 issued to B. H. Miller and in U.S. Pat. No. 3,881,775 to McPherson, et al. The present invention may be employed in connection with such mechanically enlarged well bores. Increased compaction will result in more of the bitumen bearing material being brought into contact with the solvent and rotary agitating tool described in the above-mentioned patents.

A hydraulic jet well under-reaming process is disclosed in U.S. Pat. No. 3,155,177 issued to A. B. Fly. Hydraulic underground mining is the subject of U.S. Pat. No. 3,797,590 to Archibald, et al. The present invention is applicable to and will improve such processes. In each instance compaction of the earth strata places more of the desired substance within reach of the path of the hydraulic jet action.

Indeed, if either the mechanical or the hydraulic devices of the above-mentioned patents initially is directed toward the base of the earth strata bearing the desired material, the compactive and vibrative forces of the present invention cause the strata above the devices to collapse and fall into the lower area where the tools and devices are most effective. Also, the angle of repose of collapsed earth strata is decreased by the present invention. Such additional slumping further increases the amount of material which can be reached effectively in such mechanical and hydraulic mining operations.

The use of slip-joint casing and other means to avoid damage to wells in areas of subsidence are well known in petroleum operations and may be used in connection with the present invention. However, it is desirable from a recovery standpoint as well that compaction occur as distant from the axis of the producing vertical well as is practical to achieve and these two factors favor the use of enlarged well bores and horizontal wells connected to vertical wells. It has been noted above that the equilibrium or balance between the mass of an overburden and compaction of underlying earth layers is destroyed by reducing fluid pressure in one or more of the lower strata. Similarly, increasing fluid pressure reverses the balance. Sudden changes in pressure are more effective than gradual changes in compacting and settling earth strata. Included in the present invention is to alternately raise and lower fluid pressure in the accumulation to promote compaction and porosity reduction.

SUMMARY OF THE INVENTION

The present invention relates to the recovery of petroleum substances from underground accumulations in earth strata. Disclosed are means to enhance the contribution of compaction to recovery through well bores, and more particularly the recovery of viscous liquids and semi-liquids such as tars and bitumens. Because means are shown for the recovery of earth strata solid materials associated with petroleum substances the present invention also is applicable to the recovery of any underground substance whether liquid or solid, which may be disintergrated by hydraulic or mechanical means at a distance from a well. The term petroleum substance as used herein includes all such friable materials. These solids may be slurrified in order to be lifted to the surface, unless the act of comminution itself provides the desired slurry-like condition. Solvents or diluents may be used to reduce the viscosity of tars and bitumens sufficiently for flow to occur but still retain sufficient viscosity to carry the solids. Or, emulsions may be used.

Compaction of earth strata containing an accumulation of petroleum substance may result from the natural forces due to the mass of the overburden and is aided by an additional mass of solid or liquid material, or both, placed on the surface above the accumulation as is disclosed herein. The added mass should be substantial. Process effectiveness depends mainly upon subsurface depth of the accumulation, character of the overlying strate, area of accumulation under development and the total weight of material added. It should be understood also that the method of the present invention cannot be applied very effectively to accumulations having an area that is small in relation to depth. Compaction also is caused by vibratory forces of an explosive or other devices acting near to or on the surface of the earth. Vibratory forces shear or break the bond between earth particles so that the mass of upper earth layers and any additions thereto will act more directly downward due to the force of gravity and not be dissipated to side areas away from the accumulation of petroleum substance. In some instances such seismic waves or vibrations may be equally or more effective than additional mass alone in causing compaction and porosity decrease. Furthermore, vibrations act to collapse hanging walls which may result from enlargement of well bores as disclosed by the aforementioned patents to Ranney, Miller, McPherson, Fly and Archibald, et al. The detrital collapsed material is produced and lifted with the fluids produced or employed in the operation through wells. Thus the present invention includes not only an increased recovery of petroleum substance due to compaction of earth strata but also the recovery due to an increase in the production of solid material caused by the methods disclosed. The present invention is applicable to vertical wells, to vertical wells having enlarged bores and to horizontally formed wells connected to vertical wells.

DETAILED DESCRIPTION OF INVENTION

Figure 1:
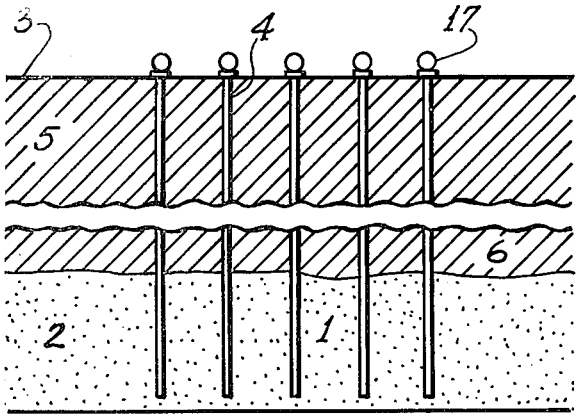
FIG. 1 is a cross sectional schematic view of an accumulation of petroleum substance after drilling but before production therefrom.
Figure 2:
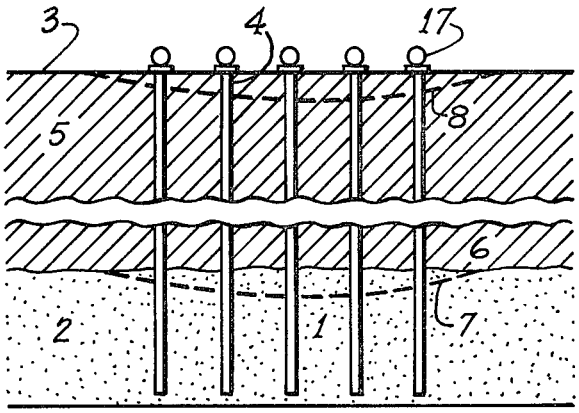
FIG. 2 is similar to FIG. 1 and shows natural compaction of earth strata and surface subsidence resulting from withdrawal of petroleum substance.
Figure 3:
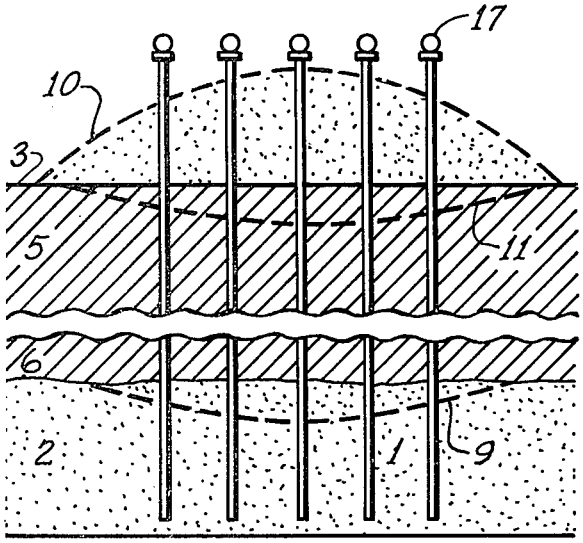
FIGS. 3, 4, 5 and 6 are cross sectional schematic views showing different embodiments of the present invention.
Figure 4:
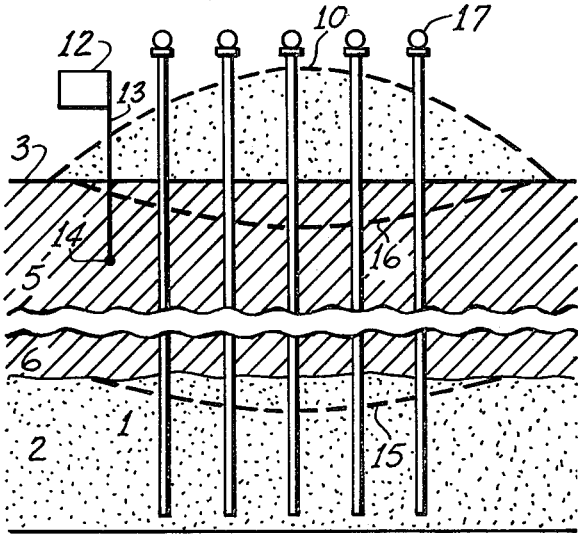

The drawings and description which follow explain the present invention in principle and in operation. FIG. 1 shows an underground accumulation of petroleum substance 1 in earth strata 2 as it existed below the surface 3 of the earth after the drilling of wells 4 through upper earth layers 5 and 6 into accumulation 1, but before withdrawal of fluid therefrom. FIG. 2 portrays the same accumulation after production of petroleum substance with broken line 7 representing the top of earth strata 2 following natural compaction with surface subsidence resulting therefrom being shown by broken line 8. In FIG. 3 broken line 9 depicts the additionally lowered contact between earth strata 2 and earth layer 6 caused by increasing the overburden mass above accumulation 1 by placement of sand 10 on surface 2 and broken line 11 shows the incremental surface subsidence resulting therefrom. In FIG. 4 a shot hole rig 12 and shot hole 13 are used to place explosive 14 into earth layer 5 and detonate same. Repeated detonations additionally settle the earth layers with broken line 15 showing the new position of the contact between earth strata 2 and earth layer 6. Also, broken line 16 shows the additional subsidence of the surface 3 caused thereby.

Figure 5:
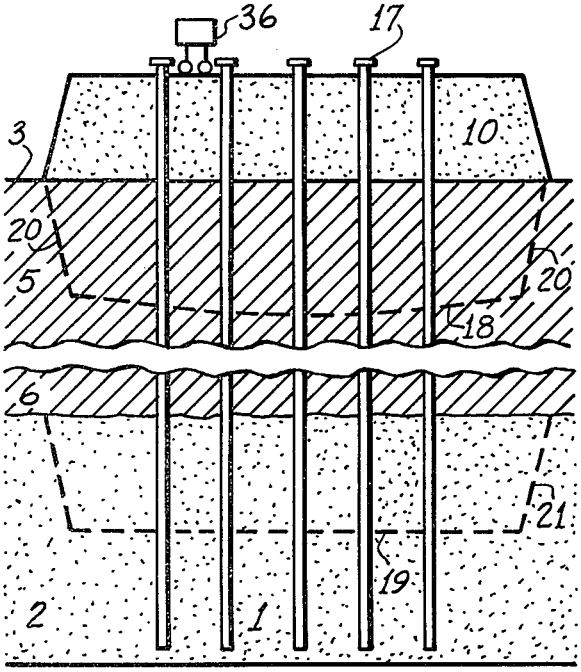

In FIGS. 3, 4, 5 and 6 the wellheads 17 of wells 4 have been elevated to permit continued ready access thereto. FIG. 5 shows the result of producing solid material of earth strata 2 with petroleum substance as by utilization of the hydraulic or mechanical systems of under reaming and mining disclosed by the patents referenced hereinbefore, or by other means. Solids produced from earth strata 2, after cleaning, are shown as deposit 10 on surface 3 above accumulation 1. Of course, water may be added to fill the pores of the solids and thereby increase substantially the mass above the accumulation. Subsidence of the surface 3 to a new position is shown by broken line 18 and the contact between earth layer 6 and strata 2 is shown by broken line 19. Broken lines 20 and 21 depict shear or faulting in the various earth layers and strata caused by the greater overburden mass 10 and by vibrations resulting from the detonation of explosive 14. Also schematically shown in FIG. 5 is a vibroseis unit 36, this being a mechanical device for generating vibrations in the earth and normally used in reflection seismograph surveys, but employed in the present invention to vibrate and compact solid material in and above accumulation 1.

Figure 6:
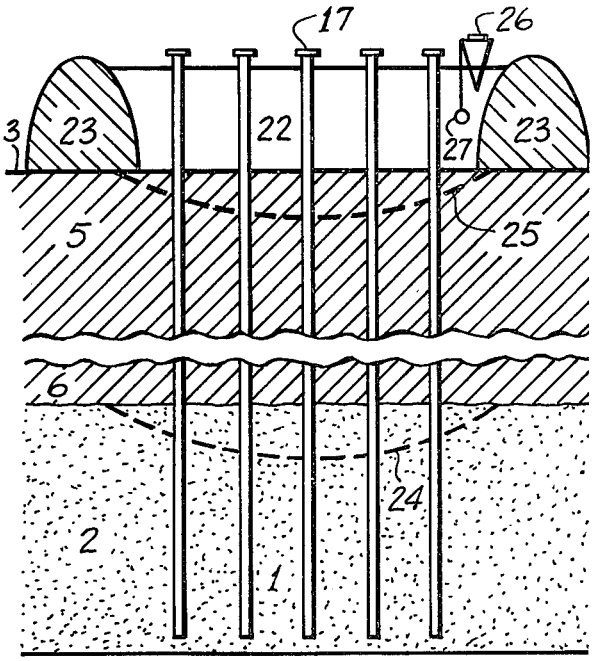

FIG. 6 illustrates the use of water 22 contained above accumulation 1 by dikes 23 to compact underlying earth layers as shown by broken lines 24 and 25. A marine vessel 26 is equipped with a popgun underwater explosive means 27 to create vibrations to compact and settle earth layers below it.

Figure 7:
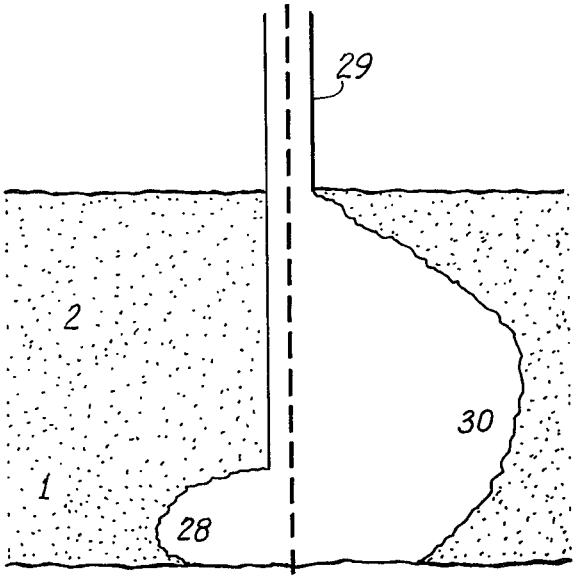
FIGS. 7 and 8 are cross sectional schematic views of earth strata containing petroleum substance wherein the bore holes have been enlarged mechanically and hydraulically respectively.
Figure 8:
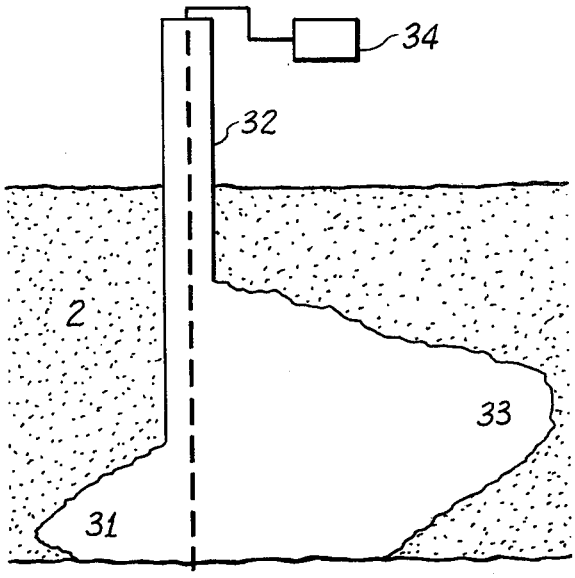

All of the operations necessary to practice the present invention, shown in FIGS. 1 to 6, are well known to those skilled in the related arts. Involved are widely used petroleum drilling, well completion and production methods, standard geophysical technology, the movement of sand and other solids by slurrification, dump truck or conveyor belt, the impoundment of water by dikes and the removal of oil from solids as is practised regularly in disposal of cuttings in offshore drilling work. Vibratory means used in pile driving or driving conductor pipe are used in the present invention. It is the novel and useful combinations of these widely practised operations which constitute the present invention and not the individual operations. The left side of FIG. 7 shows an underground cavity 28 mechanically formed in earth strata 2 from well bore 29 as by the means disclosed in the patents to Miller or to McPherson mentioned hereinbefore near the base of petroleum substance accumulation 1. The right hand side of FIG. 7 shows the enlargement of cavity 28 into cavity 30 by use of the present invention. Similarly, FIG. 8 shows an underground cavity 31 formed in earth strata 2 from well bore 32 by hydraulic means as described by Archibald, et al or Fly in patents listed earlier herein with the left side cavity 31 being before and the right side cavity 33 being after employment of the present invention. Also shown in FIG. 8 is pump 34 connected to well 32 used to change fluid pressure within void area 33. Alternate increase and decrease in pressure, "breathing", aids in the enlargement of cavity 33 thereby increasing the recovery of petroleum substance. Additionally, pump 34 may be used to pressure liquid for use in a jet nozzle to pulp the solid material of earth strata 2 and form a slurry thereof as disclosed by Archibald, et al in U.S. Pat. No. 3,797,590.

Figure 9:
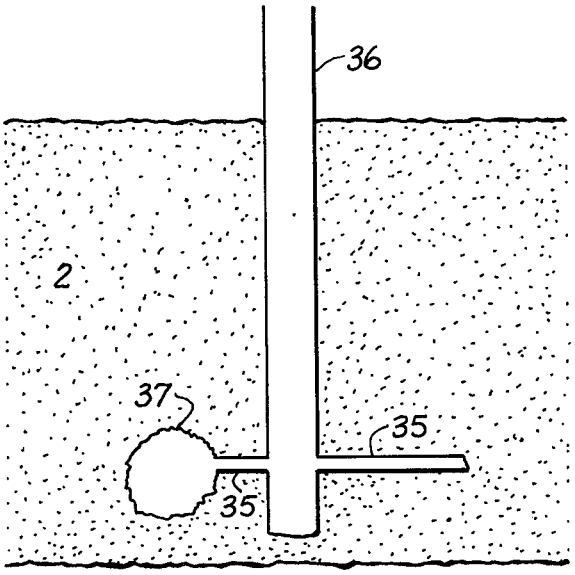
FIGS. 9 and 10 are cross sectional schematic views of lateral wells as contemplated in this invention.
Figure 10:
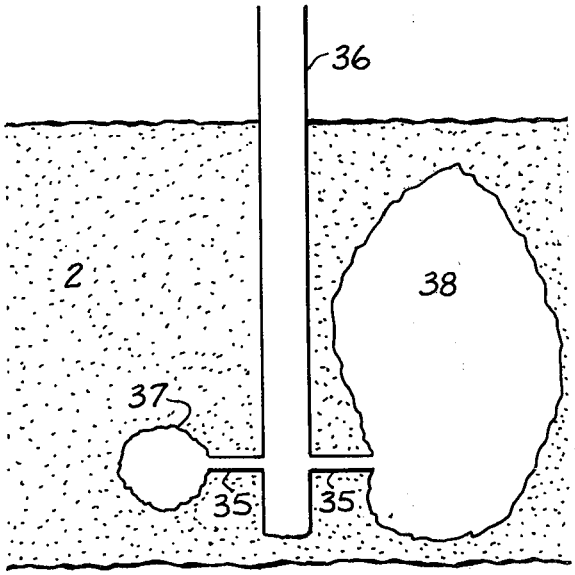

FIG. 9 on the right side shows a lateral well 35 connected to vertical well 36 penetrating earth strata 2 while the left side of FIG. 9 shows cavity 37 formed at the extreme end of horizontal well 35 by hydraulic means. FIG. 10 is similar to FIG. 9 and shows an enlarged cavity 38 formed by hydraulic means aided by use of the present invention.

While several forms of the invention have been shown and described, other forms may be realized as coming within the scope of the invention as defined in the appended claims.

I claim:

1. The method of recovering petroleum substance from an underground accumulation in earth strata comprising:
(a) drilling a first well into said strata,
(b) placing a substantial mass above said accumulation to compact said earth strata and reduce the porosity thereof, and
(c) expelling said petroleum substance into said first well.

2. The method of claim 1 including the step of reducing the pressure in said accumulation prior to placing said mass.

3. The method of claim 1 including the step of enlarging the bore of said first well.

4. The method of claim 3 including the step of alternately increasing and decreasing the pressure in said first well.

5. The method of claim 3 including the step of drilling a plurality of said first wells.

6. The method of claim 1 including the step of creating vibrations in said earth strata.

7. The method of claim 6 wherein said vibrations are created by underwater means.

8. The method of claim 1 including the step of alternately increasing and decreasing fluid pressure in said first well.

9. The method of claim 8 including the step of forming at least one lateral passageway from said well.

10. The method of claim 1 including drilling a plurality of wells.

11. The method of claim 1 including the step of forming at least one lateral passageway from said first well.

12. The method of recovering petroleum substance from an underground accumulation in earth strata solid material comprising:
(a) drilling a first well into said earth strata,
(b) removing a portion of said earth strata solid material and petroleum substance,
(c) cleaning said earth strata solid material by removal of petroleum substance therefrom, and
(d) placing said cleansed earth strata solids on the surface above said accumulation to increase overburden pressure on said accumulation.

13. The method of claim 12 including the step of adding water to said earth strata material.

14. The method of claim 12 in which liquid is introduced into the underground accumulation to form a slurry with the solid material and petroleum substance and recovering said slurry through said first well.

15. The method of claim 12 including the step of forming at least one lateral passageway from said well.

16. The method of claim 12 including the step of creating vibrations in said earth strata.

17. The method of recovering petroleum substance from an underground accumulation in earth strata comprising:
(a) drilling a first well into said earth strata,
(b) placing a substantial mass on the surface above said accumulation to compact said earth strata and reduce the porosity thereof, and
(c) pulping said earth strata to form a slurry thereof and recovering said slurry through said first well.

18. The method of claim 12 including the step of reducing the pressure in said accumulation prior to placing said mass.

19. The method of claim 17 including the step of creating vibrations in said earth strata.

20. The method of claim 17 including the step of enlarging the bore of said first well.

21. The method of claim 20 wherein said enlargement is formed by mechanical means.

22. The method of claim 20 wherein said enlargement is formed by hydraulic means.

23. The method of claim 20 including the step of forming a lateral passageway from said first well.

24. The method of claim 23 including drilling a plurality of said wells.

25. The method of claim 17 including the step of forming at least one lateral passageway from said well.

26. The method of recovering petroleum substance from an accumulation in underground earth strata comprising:
(a) drilling a first well into said strata,
(b) placing a substantial mass above said accumulation to compact said earth strata and reduce the porosity thereof,
(c) enlarging the bore of said first well, and
(d) removing said earth strata and petroleum substance through said first well.

27. The method of claim 26 including the step of alternately increasing and decreasing fluid pressure in said first well.

28. The method of claim 27 including the step of forming at least one lateral passageway from said first well.

29. The method of claim 26 including the step of drilling a plurality of said wells.

30. The method of claim 26 including the step of pulping said earth strata and petroleum substance to form a slurry thereof and recovering said slurry through said well.

* * * * *